United States Patent [19]

Manabe et al.

[11] Patent Number: 4,816,124

[45] Date of Patent: Mar. 28, 1989

[54] METAL-COATED FIBROUS OBJECTS

[75] Inventors: Katsuhide Manabe; Masatoshi Tsutsui, both of Aichi; Toshimasa Suzuki, Gamagori; Masayuki Suzuki, Aichi; Yoshifumi Nishibayashi, Gamagori, all of Japan

[73] Assignee: Toyoda Gosei Company, Ltd., Gamagori, Japan

[21] Appl. No.: 894,873

[22] Filed: Aug. 8, 1986

Related U.S. Application Data

[62] Division of Ser. No. 682,332, Dec. 17, 1984, abandoned.

[30] Foreign Application Priority Data

Dec. 19, 1983 [JP] Japan ..... 58-239277

[51] Int. Cl.[4] ..... C23C 14/00

[52] U.S. Cl. ..... 204/192.14; 204/192.1; 204/192.15; 204/192.16; 204/192.25

[58] Field of Search ..... 204/192.1, 192.14, 192.16, 204/192.15, 192.25

[56] References Cited

U.S. PATENT DOCUMENTS

| | | | |
|---|---|---|---|
| 2,703,277 | 3/1955 | Spendelow et al. | 75/171 |
| 2,867,552 | 1/1959 | Homer | 428/389 |
| 2,963,739 | 11/1952 | Whitehurst et al. | 65/3.3 |
| 3,041,202 | 6/1962 | Whitehurst | 65/11 |
| 3,046,170 | 7/1962 | Toulmin, Jr. | 154/43 |
| 3,074,256 | 1/1963 | Whitehurst et al. | 65/11 |
| 3,640,832 | 2/1972 | Kurz | 161/160 |
| 3,660,138 | 5/1972 | Gorrell | 117/35 V |
| 4,010,308 | 3/1977 | Wiczer | 428/372 |
| 4,042,737 | 8/1977 | Forsgren et al. | 428/96 |
| 4,169,911 | 10/1979 | Yoshida et al. | 428/36 |
| 4,364,792 | 12/1982 | Gliem et al. | 204/192.14 X |
| 4,369,225 | 1/1983 | Manabe | 204/192.14 |
| 4,374,717 | 2/1983 | Drauglis et al. | 204/192.14 |
| 4,390,589 | 6/1983 | Geyling et al. | 428/381 |
| 4,410,567 | 10/1983 | France et al. | 427/163 |
| 4,479,862 | 10/1984 | Swenson | 204/192.14 |
| 4,525,261 | 6/1985 | Hotta et al. | 204/192 EC |

FOREIGN PATENT DOCUMENTS

| | | | |
|---|---|---|---|
| 54-116500 | 9/1979 | Japan . | |
| 0264102 | 2/1970 | U.S.S.R. | 204/192.14 |
| 1185260 | 3/1970 | United Kingdom . | |

OTHER PUBLICATIONS

"Method of Improving the Adhesion of Metallic Layers on Curable Plastics", Czepluch et al., IBM Technical Disclosure 11/1984.

Kirk-Othmer, Encylopedia of Science and Technology, Index, p. 567 (1984).

Lyman, editor, Metals Handbook, Vol. I, pp. 466, 467, 476, 485, 513, 584, 585, 616, 1127, 1263 (8th ed. 1961).

*Primary Examiner*—Thurman K. Page

*Attorney, Agent, or Firm*—Cushman, Darby & Cushman

[57] ABSTRACT

Metal-coated fibrous objects comprising a fibrous base material, such as raw fibers, yarns, fabrics and final textile products; a synthetic resin base coat applied thereto; and a layer of metal deposited on said base coat by sputtering to a thickness in the range from 50 to 10,000 Å. The metal is selected from the group consisting of gold, silver, aluminum, tin zinc, nickel, copper, cobalt and chromium, or selected from the group consisting of Hastelloy X, Permalloy, stainless steels, titanium nitride and cobalt alloys. The sputtering is carried out in an atmosphere of an inert gas selected from argon, neon and xenon, under a pressure in the range from $3\times10^{-4}$ to $9\times10^{-2}$ Torr, and at an impressed voltage in the range from 200 to 1,000 volts.

2 Claims, 1 Drawing Sheet

METAL-COATED FIBROUS OBJECTS

This is a division of application Ser. No. 682,332, filed Dec. 17, 1984, abandoned.

BACKGROUND OF THE INVENTION

1. Field of the Invention

The present invention relates to metal-coated fibrous objects comprising a fibrous base material, such as raw fibers, yarns, fabrics and final textile products, and a layer of metal deposited thereon.

2. Description of the Prior Art

Vacuum deposition and electroless plating have been proposed as a means for the manufacture of metal-coated fibrous objects.

For example, a technique is known in which a thin layer of aluminum is formed on the surface of twisted yarns by vacuum deposition, and woven, knitted and nonwoven fabrics are made from the metal-coated yarns thus prepared. This method, however, can hardly be put into practical use because of poor adhesion of the aluminum layer to the substrate fiber; the deposited metal tends to become detached in the succeeding fabric making steps or when resulting fabrics are strongly rubbed. Furthermore, fabrics made of such yarns cannot be laundered because the deposited aluminum is removed almost completely by a single normal laundering.

Our study revealed that such troubles are caused by the facts that, in the vacuum deposition process, the energy of metal vapor bombarding the substrate fiber is too low to achieve sufficient adhesion and that light metals such as aluminum have poor resistance to acids and alkalis.

Another problem associated with vacuum deposition is that the metals that can be used are limited only to those which melt at relatively low temperatures and vaporize with relative ease. This eliminates the use of highly corrosion-resistant materials, such as stainless steel and tungsten.

Metal-coated fibrous objects made by electroless plating are also known. For example, dyed pieces of cloth are plated through immersion in an electroless plating solution, followed by several processing steps. This method is disadvantageous in that the discharged plating solution can cause pollution problems and hence a significant cost is added for the treatment of the used solution. In addition, this wet process requires drying and related steps, and suffers from deterioration of plated fabrics.

Other difficulties are that, although copper, nichel, chromium, cobalt and some other metals can be plated with comparative ease, the method is not applicable to alloys, the metals which are difficult to be put into solution, and the metals which are unstable in solution, and that firm attachment of metal layer to fiber substrate cannot be expected because the plated layer is likely to be thick.

SUMMARY OF THE INVENTION

An object of the present invention is to offer new metal-coated fibrous objects with favorable metallic appearance and excellent light- and heat-shielding properties, in which any desired metal is firmly and reliably attached to substrate fiber while maintaining the characteristic functions of the fibrous base materials (raw fibers, yarns, fabrics and final textile products).

Another object of the present invention is to offer metal-coated fibrous objects with improved resistance to acids, alkalis, water, weathering and abrasion and assuming colored metallic appearance.

To accomplish these objects, the metal-coated fibrous objects of the present invention comprise a fibrous base material, such as raw fibers, yarns, fabrics and final textile products; a synthetic resin base coat applied thereto; and a layer of metal deposited on said base coat by sputtering to a thickness in the range from 50 to 10,000 Å.

Other objects of the present invention will become apparent from the preferred embodiments described below and the appended claims, and many other advantages not mentioned herein will be understood by those skilled in the art who put the present invention into practice.

BRIEF DESCRIPTION OF THE INVENTION

DETAILED DESCRIPTION OF THE PREFERRED EMBODIMENTS

Figure 1:
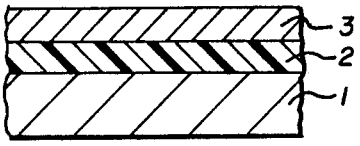
FIG. 1 is a schematic cross-sectional view illustrating a preferred embodiment of the present invention.
Figure 3:
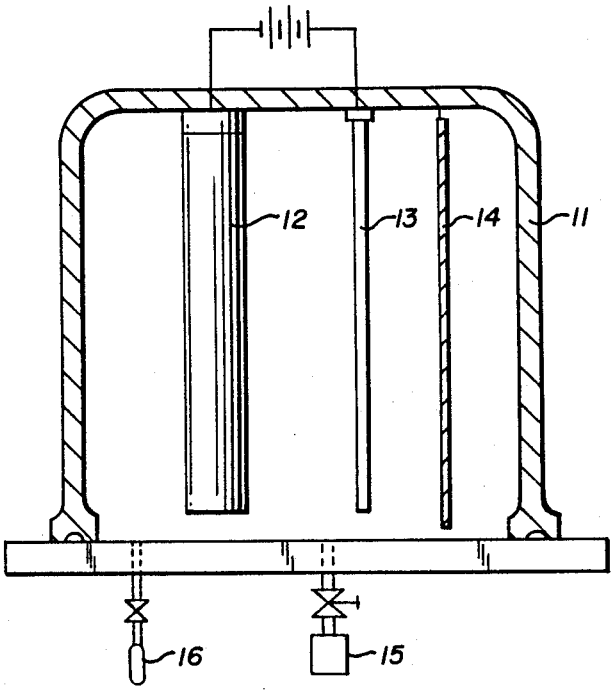
FIG. 3 is the schematic cross-sectional view of a sputtering apparatus.

A first preferred embodiment of the present invention will be explained below by referring to FIGS. 1 and 3.

The fibrous base material 1 may be any type of raw fiber, such as synthetic and natural fibers (e.g., polyesters, polyacrylonitriles, polyamides, rayon, cotton and wool), special fibers such as glass fiber and carbon fiber, or any combination thereof; a twisted yarn made from such raw fibers; a woven, knitted or nonwoven fabric made therefrom, which may have been raised or flocked for higher quality or rendered flame-retardant with, for example, a phosphorus compound; or the like. In Examples 1 and 2 described later, plain weave fabrics made of 1-denier and 2-denier polyester fibers were used respectively as the fibrous base material 1.

As the base coat 2 to be applied to the fibrous base material 1 may be used any synthetic resin coating of acrylic or polyester type. In Examples 1 and 2, a clear, two-can urethane coating of acrylic type and a clear, two-can urethane coating of polyester type were applied respectively to a coating thickness of 2 to 10 microns.

The base coat 2 may be applied to the fibrous base material 1 by spraying, dipping, roller coating or flow coating, each process having characteristic features of its own as shown later.

The metal 3 to be deposited on the base coat 2 may be any metal or alloy that can be sputtered. Of particular advantage are metals such as gold, silver, aluminum, tin, zinc, nickel, copper, cobalt and chromium, Hastelloy X and Permalloy which are corrosion-resistant, nickel-base alloys, SUS316 (JIS) which is a stainless steel, titanium nitride, cobalt-base alloys, and others. The type of metal to be used may be selected depending of the particular use, the color desired, cost and other factors. In Examples 1 and 2, Hastelloy X and Permalloy were used respectively.

The sputtering operation to deposite the metal 3 on the base coat 2 will be explained below by referring to FIG. 3. In this figure, numeral 11 represents a vertical, low-temperature, high-rate sputtering apparatus equipped with an evacuating unit 15 and an argon gas cylinder 16 on the side at bottom portion. Numeral 12 shows a cylindrical target which is made, at least at its surface layer, of the metal to be deposited, such as Hastelloy X or Permalloy. Numeral 13 expresses a rod-shaped anode, which is designed to be impressed with a DC voltage of 200 to 1,000 volts against the target 12. Behind this anode 13 is set a fabric 14 (fibrous base material), which has previously been thoroughly scoured with a neutral detergent to remove oil, dirt and any other foreign substances and dried.

The sputtering apparatus 11 is first evacuated by running the evacuating unit 5 to a pressure on the order of $10^{-5}$ Torr, argon gas is introduced to a pressure of $4\times10^{-4}$ Torr, and a proper voltage is applied across the target 12 and anode 13. Metal molecules emitted from the surface of the target 12 are thus deposited on the opposite surface of the fabric 14. In Examples 1 and 2, the thickness of metal layer formed were 500 Å for both, and the time required was about 30 seconds.

Table 1 summarizes the properties of the treated fabrics thus obtained, together with those of a comparative example in which Hastelloy X was directly deposited by sputtering on a plain weave fabric made of 1-denier polyester fiber to a thickness of 500 Å. The adhesion was herein evaluated by visual observation after immersion in 40° C. hot water for 120 hours.

TABLE 1

| | Metallic Gloss | Light Reflectance | Adhesion |
|---|---|---|---|
| Example 1 | ◎ | 100% | ◎ |
| Example 2 | ◎ | 100% | ◎ |
| Comparative Example | ○ | 99% | ○ |

◎ : Excellent ○ : Good

As may be apparent from the table, the metal-coated fabrics obtained in Examples 1 and 2 are excellent in metallic gloss, light reflectance and adhesion to base coat 2, indicating that a metal coating thickness of 500 Å is sufficient to achieve satisfactory results. In Comparative Example, on the other hand, metallic gloss, light reflectance and adhesion are all slightly poorer with the same thickness because of the absence of base coat 2 on fabric 14.

Applying a base coat 2 to the fibrous base material 1 prior to sputtering helps smooth the fine unevenness on fiber surface, minimizing irregular reflection at the metal layer 3 and giving treated fabrics of better metallic look. The base coat also serves to achieve higher adhesion of deposited metal, thus imparting higher resistance to repeated laundering. Other advantages over conventional methods include higher resistance to heat, melting and weathering, as well as better water repellency, electromagnetic-wave shielding property and electroconductivity, which make the metal-coated fibrous objects of the present invention usable for a wide range of applications.

Suitable conditions of sputtering are detailed below. Neon, xenon and many other inert gases may also be used in place of argon at a pressure in the range from $3\times10^{-4}$ to $9\times10^{-2}$ Torr. If the pressure is less that $3\times10^{-4}$ Torr, it is difficult to effect satisfactory sputtering, while blacking is likely to occur if the pressure exceeds $9\times10^{-2}$ Torr. Any impressed voltage may be adopted so long as sputtering can be effected satisfactory, but its preferable range is normally between 200 and 1,000 volts.

The thickness of deposited metal layer may be selected in the range from 50 to 10,000 Å. When the thickness reaches about 100 Å, a faint metal color begins to appear, and a full metal color can be obtained at a thickness of about 300 Å. When the thickness increases to about 500 Å, the metal layer exhibits electroconductivity, light- and heat-shielding properties, and still other useful charactristics.

Table 2 lists experimental examples for typical application methods of base coat 2 to fibrous base material 1 (spraying, dipping, roller coating and flow coating), and compares their features.

TABLE 2

| Method | Experimental Examples | Features |
|---|---|---|
| Spray Coating | A plain weave fabric made of 2-denier polyester fiber was sueded by raising, and two-can urethane coating of acrylic type (non-yellowing) was applied with an add-on of 20 g/m$^2$, followed by drying (80° C. × 120 min) and sputtering. | Fibrous feel not impaired; stereoscopic metallic look. |
| Dip Coating | A plain weave fabric made of 1-denier polyester fiber was applied with two-can urethane coating of polyester type (non-yellowing) with an add-on of 100 g/m$^2$, followed by drying (80° C. × 120 min) and sputtering. | Enhanced film-like feel; flat metallic gloss. |
| Roller Coating | A stretch fabric made of 1-denier cotton fiber was applied with one-can urethane coating with an add-on of 50 g/m$^2$, which was set by immersion in water, followed by drying (80° C. × 120 min) and sputtering. | Same as above. |
| Flow Coating | A plain weave fabric made of 1-denier polyester fiber was sueded by raising, and two-can urethane coating of polyester type (non-yellowing) was applied with an add-on of 30 g/m$^2$, followed by drying (80° C. × 120 min) and sputtering. | Same as spray coating. |

Figure 2:
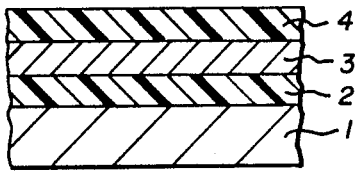
FIG. 2 is a schematic cross-sectional view of another preferred embodiment of the present invention.

A second preferred embodiment of the present invention will be explained below by referring to FIG. 2. In this case, the synthetic resin topcoat 4 is further applied to the surface of the metal layer 3 deposited by sputtering.

As the material of topcoat 4 may be used any of the clear, two-can urethane coatings of acrylic or polyester type employed for the base coat 2, or any clear, one-can urethane coating of acrylic type. The topcoat 4 serves to protect the metal layer 3 deposited by sputtering, thus imparting the final product with improved resistance to acids, alkalis, water, weathering and abrasion. It is also possible to give metal-coated fibrous objects having a colored metallic look if a dye or pigment (organic or inorganic) is incorporated in this topcoat. The topcoat 4 may be applied by any of the coating methods described in the first preferred embodiment, but spray coating and roller coating are advantageous in terms of coating efficiency.

The metal-coated fibrous objects of the present invention have various useful characteristics mentioned above while retaining the properties of the fibrous base materials used: lightweight, pliability, air permeability, water absorbing capability, and ease of cutting and sewing. With these outstanding features, they are of great value in the following applications:

a. Draperies (light- and heat-shielding properties and weatherability)
b. Lining cloths (favorable hand and antistatic property)

c. Automobile ceiling materials and coldproof clothes (high light- and heat-shielding properties, ability to keep warm)

d. Automobile fabric linings around ashtrays and fireproof clothings (incombustibility, flame retardancy and thermal resistance)

e. Computer malfunction preventive materials and protective clothings against electromagnetic wave (electromagnetic shielding property)

f. Automobile interior fabrics to prevent sparks caused by electrostatic charges (electroconductivity and antistatic property)

As may be apparent from the foregoing, the metal-coated fibrous objects of the present invention feature improved metallic look, higher adhesion of deposited metal and better light- and heat-shielding properties, have higher resistance to acids, alkalis, heat, weathering and abrasion, and also assume colored metallic look as desired.

While only a few preferred embodiments have been shown by way of illustration, many widely different embodiments may be made without departing from the scope and spirit of the present invention as defined in the appended claims.

What is claimed is:

1. The process for preparing a metal-coated fibrous object comprising of applying a base coat consisting of an urethane paint to a fibrous base material and thereafter depositing a layer of metal from 50 to 10,000 Å in thickness on said base coat, said depositing being carried out in an atmosphere of an inert gas selected from the group consisting of argon, neon and xenon, under a pressure in the range from $3\times10^{-4}$ to $9\times10^{-2}$ Torr, and at an impressed voltage in the range from 200 to 1000 volts.

2. The process according to claim 1 wherein the thickness of the deposited metal layer is in the range of 300 Å to 500 Å.

* * * * *

UNITED STATES PATENT AND TRADEMARK OFFICE

CERTIFICATE OF CORRECTION

PATENT NO. : 4,816,124

DATED : March 28, 1989

INVENTOR(S) : Manabe et al

It is certified that error appears in the above-identified patent and that said Letters Patent is hereby corrected as shown below:

ON THE TITLE PAGE

Change "[73] Assignee: Toyoda Gosei Company, Ltd., Gamagoria, Japan"

to --[73] Assignee: Toyoda Gosei Company, Ltd., Nishikasugai, Japan and Suzutora Seisen Company, Ltd., Gamorgia, Japan--

IN THE CLAIMS

Claim 1, column 6, line 8 after comprising delete "of".

Signed and Sealed this

Nineteenth Day of December, 1989

*Attest:*

JEFFREY M. SAMUELS

*Attesting Officer*

*Acting Commissioner of Patents and Trademarks*